US012635823B2

(12) United States Patent
Huang

(10) Patent No.: US 12,635,823 B2
(45) Date of Patent: May 26, 2026

(54) CLAMPING BASE AND CHRISTMAS TREE

(71) Applicant: Shenzhen Maining Innovation Technology Co., Ltd., Shenzhen (CN)

(72) Inventor: Huifeng Huang, Shenzhen (CN)

(73) Assignee: Shenzhen Maining Innovation Technology Co., Ltd., Shenzhen (CN)

( * ) Notice: Subject to any disclaimer, the term of this patent is extended or adjusted under 35 U.S.C. 154(b) by 46 days.

(21) Appl. No.: 18/991,405

(22) Filed: Dec. 21, 2024

(65) Prior Publication Data

US 2025/0120529 A1 Apr. 17, 2025

(30) Foreign Application Priority Data

Aug. 19, 2024 (CN) ..... 202422012442.X

(51) Int. Cl.
*F16M 13/00* (2006.01)
*A47G 33/12* (2006.01)

(52) U.S. Cl.
CPC ..... *A47G 33/1206* (2013.01); *A47G 33/126* (2013.01)

(58) Field of Classification Search
CPC ..... A47G 33/1206; A47G 33/126; A47G 2033/122; A47G 33/06
See application file for complete search history.

(56) References Cited

U.S. PATENT DOCUMENTS

| | | | | |
|---|---|---|---|---|
| 6,739,566 | B1 * | 5/2004 | Kao | A47G 33/126 248/522 |
| 6,854,700 | B2 * | 2/2005 | Schmitz | A47G 33/1213 248/525 |
| 9,375,109 | B2 * | 6/2016 | Hammond | A47G 33/1226 |
| 10,182,677 | B2 * | 1/2019 | Rapp | A47G 33/1226 |
| 2012/0112425 | A1 | 5/2012 | Hickey | |
| 2018/0008077 | A1 | 1/2018 | Watson | |
| 2023/0029352 | A1 | 1/2023 | Zhao | |

* cited by examiner

*Primary Examiner* — Amy J. Sterling

(57) ABSTRACT

A clamping base includes a housing, a supporting body disposed in the housing, and clamping members and a locking member that are mounted on the supporting body. A placement groove configured to accommodate a placed object is provided in the supporting body, a plurality of sliding grooves are obliquely provided on an inner wall of the placement groove, the sliding grooves extend toward a center of the placement groove from top to bottom, the clamping members are circumferentially disposed in the placement groove, and sliders capable of sliding along the sliding grooves are disposed on the clamping members; the locking member is connected to an upper part of the supporting body; a ring-shaped pressing ring is disposed on a top of the locking member; and an elastic member capable of pushing the clamping member to return is further disposed between the clamping member and the supporting body.

10 Claims, 9 Drawing Sheets

CLAMPING BASE AND CHRISTMAS TREE

CROSS-REFERENCE TO RELATED APPLICATIONS

This application claims priority to Chinese Patent Application No. 202422012442X with a filing date of Aug. 19, 2024. The content of the aforementioned application, including any intervening amendments thereto, is incorporated herein by reference.

TECHNICAL FIELD

This application belongs to the field of object fixing technologies, and specifically relates to a clamping base and a Christmas tree.

BACKGROUND

A Christmas tree is an evergreen tree that is a fir or a pine decorated with candles or ornaments, and is one of important constituent parts of the Christmas Day.

A supporting base is usually mounted on a bottom of the Christmas tree to reliably fix the Christmas tree, thereby avoiding tilting or skewing.

However, an existing supporting base of the Christmas tree has the following problems: A Christmas tree body and the base are usually in threaded connection, causing inconvenience in mounting and dismounting, and posing a high requirement on strength of a threaded structure. In addition, after being assembled, the Christmas tree needs to have enough space around, to have a high ornamental value, resulting in a high requirement on space.

SUMMARY

An objective of this application is to provide a clamping base and a Christmas tree. A placed object is clamped and mounted via a slide fitting structure between a clamping member and a supporting body, so that a dismounting process of the placed object on the base is simplified, a rotation function of the base is further increased, the placed object is ensured to be shown in limited space, and an ornamental value of the placed object is improved.

To achieve the objective, this application adopts the following technical solution: A clamping base includes a housing, a supporting body disposed in the housing, and a plurality of clamping members and a locking member that are mounted on the supporting body, where a placement groove configured to accommodate a placed object is provided in the supporting body, a plurality of sliding grooves are obliquely defined on an inner wall of the placement groove, the sliding grooves extend toward a center of the placement groove from top to bottom, the plurality of clamping members are circumferentially disposed in the placement groove, and sliders capable of sliding along the sliding grooves are disposed on the clamping members; the locking member is connected to an upper part of the supporting body; a ring-shaped pressing ring is disposed on a top of the locking member, and in a downward moving process of the locking member, the pressing ring is acted on upper end surfaces of the plurality of clamping members to push the plurality of clamping members to slide toward the center of the placement groove to clamp the placed object; and an elastic member capable of pushing the clamping member to return is further disposed between each of the plurality of clamping members and the supporting body.

Further, the elastic member includes a fixed part and a bent part, where the fixed part is disposed on the plurality of clamping members, and the bent part is clamped on the supporting body.

Further, a mounting groove is defined on each of the plurality of clamping members, and the fixed part of the elastic member is disposed in the mounting groove.

Further, a clamping groove is provided on the supporting body, and the bent part of the elastic member is clamped in the clamping groove.

In a disposing manner of the supporting body, the supporting body is rotatably supported on the housing.

Further, a first accommodating cavity is defined in the housing, a first bearing is disposed below the first accommodating cavity, a second bearing is disposed above the first accommodating cavity, and the supporting body is rotatably mounted in the first accommodating cavity via the first bearing and the second bearing.

Further, a second accommodating cavity that communicates with the first accommodating cavity is further defined in the housing, the second accommodating cavity is positioned below the first accommodating cavity, a transmission mechanism is mounted in the second accommodating cavity, and the transmission mechanism is configured to drive the supporting body to rotate.

Further, the transmission mechanism includes a motor, a first gear, and a second gear, where the first gear is mounted on an output shaft of the motor, and the second gear is mounted on a lower end of the supporting body, and is engaged with the first gear.

Specifically, a rotatable connecting part is disposed on the lower end of the supporting body, both the first bearing and the first gear are mounted on the rotatable connecting part, the first bearing is sleeved on a periphery of the rotatable connecting part, and the second gear is disposed on a lower end of the rotatable connecting part.

In another disposing manner of the supporting body, the supporting body is fixed on the housing.

This application also discloses a Christmas tree, including a Christmas tree body, where the Christmas tree is mounted on the clamping base.

This application has the beneficial effects: the clamping member is pushed through downward movement of the locking member, so that the clamping member slides toward the center of the placement groove along the sliding groove that is provided in the inclined manner, to clamp the placed object. The clamping base is simple in integral structure, easy to operate, and is further applicable to clamping placed objects of different diameters, so that an applicable range of the clamping base is expanded.

In this application, when being clamped, the placed object can be further rotated along with the supporting body via the transmission mechanism. When the placed object is an ornament that needs to be displayed, for example, a Christmas tree, an aesthetic feeling of the ornament can be improved, and space occupied by the ornament is also saved.

Figure 1:
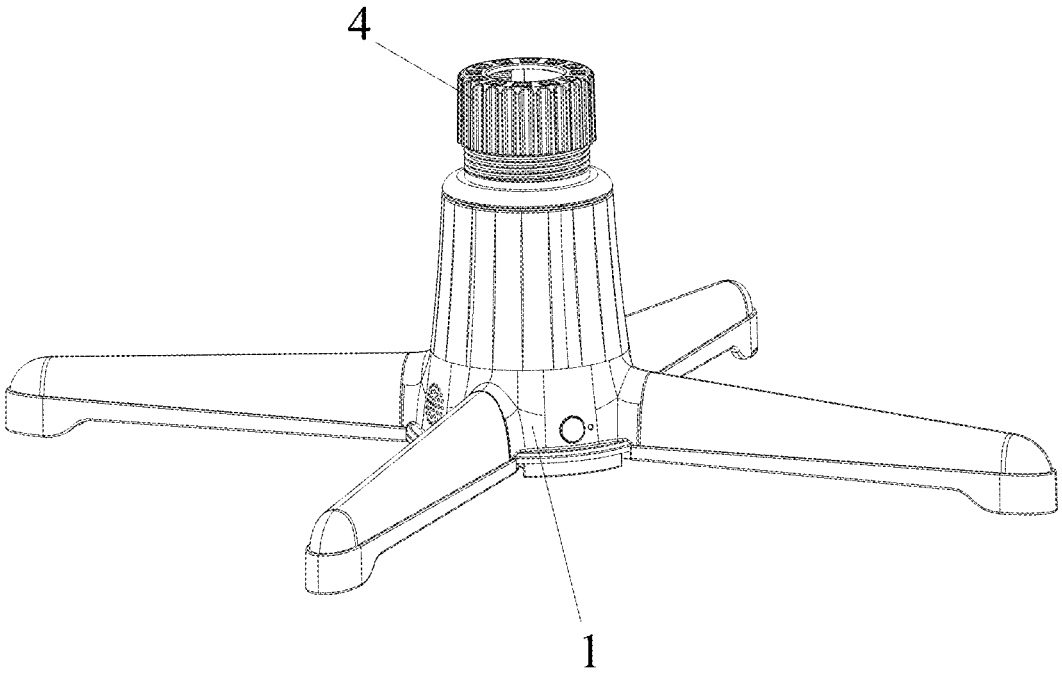
FIG. 1 is a structural schematic diagram showing a clamping base according to an implementation of this application.
Figure 2:
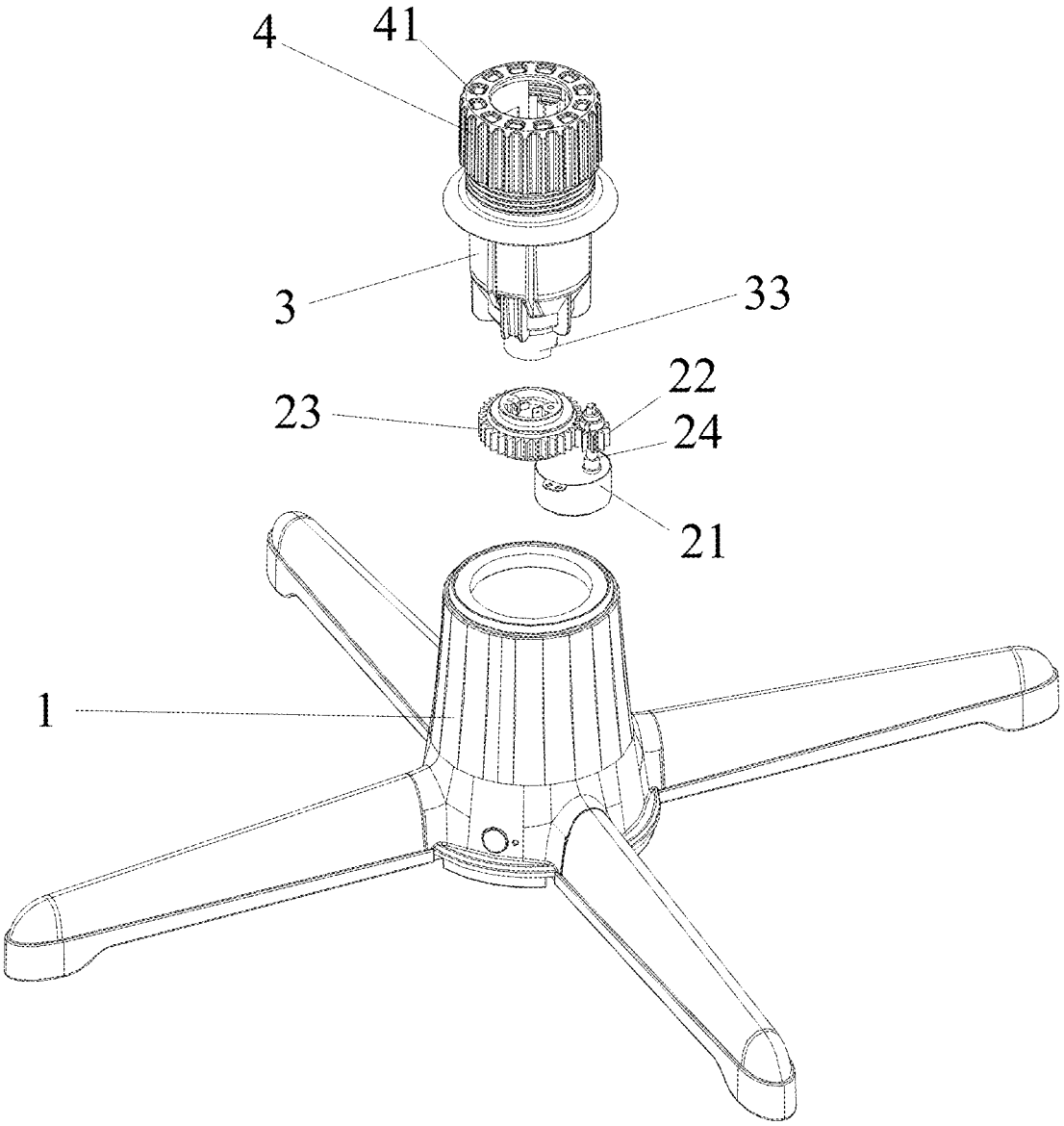
FIG. 2 is an exploded view showing the clamping base according to an implementation of this application.

Reference numbers in the figures: 1, housing; 11, first accommodating cavity; 12, second accommodating cavity;
21, motor; 22, first gear; 23, second gear; 24, output shaft;
3, supporting body; 31, threaded part; 32, placement groove; 33, rotatable connecting part; 34, sliding groove; 35, clamping groove;
4, locking member; 41, pressing ring;
51, first bearing, 52, second bearing;
6, clamping member; 61, slider; 62, mounting groove;
7, elastic member; 71, bent part; and 72, fixed part;
100, clamping base.

DETAILED DESCRIPTION OF THE EMBODIMENTS

This application is further described in detail below with reference to the drawings and embodiments, but this application is not limited thereto.

Embodiment 1: A clamping base 100 includes a housing 1, a supporting body 3, a locking member 4, clamping members 6, and elastic members 7. This embodiment is applicable to FIG. 1 to FIG. 9. The clamping base 100 is configured to clamp an ornamental object that needs to be displayed, for example, a Christmas tree.

The housing 1 includes three or four supporting legs for supporting an integral structure, a first accommodating cavity 11 is defined in the housing 1, and the supporting body 3 is mounted in the first accommodating cavity 11. A placement groove 32 configured to accommodate a placed object is defined in the supporting body 3, sliding grooves 34 are obliquely provided on an inner wall of the placement groove 32, and the sliding grooves 34 tilt toward a center of the placement groove 32 from top to bottom. The center of the placement groove 32 is the dashed line A shown in FIG. 4, FIG. 5 and FIG. 9. A plurality of clamping members 6 are circumferentially disposed in the placement groove 32, sliders 61 that are configured to be in sliding fit to the sliding grooves 34 are disposed on the clamping members 6, and the plurality of clamping members 6 in the supporting body 3 are capable of sliding along the sliding grooves 34 from top to bottom, to gradually gather toward the center of the placement groove 32. In addition, a ring-shaped pressing ring 41 is further disposed on a top of the locking member 4, and the locking member 4 is movably mounted on the supporting body 3. In a process of moving the locking member 4 from top to bottom on the supporting body 3, the pressing ring 41 is acted on top ends of all clamping members 6 to push all of the clamping members 6 to slide downward, so as to clamp the placed object in the placement groove 32, and implement clamping of the placed object. An elastic member 7 is further disposed between each clamping member 6 and the supporting body 3. In a process of unlocking the clamping member 6 by the locking member 4, elastic force of the elastic member 7 is released to push the clamping member 6 to reversely move and return along the sliding groove 34.

In an implementation of the locking member 4: The locking member 4 in this embodiment is a locking knob. A threaded part 31 is disposed on an upper part of the supporting body 3, and the locking member 4 is in threaded connection to the threaded part 31. The locking member 4 is rotated, so that the locking member 4 moves up and down on the supporting body 3.

In another implementation of the locking member 4: The locking member 4 is further connected and locked with the supporting body 3 in a pressing manner. For example, a guide post extending in a radial direction is disposed on an outer side surface of the supporting body 3 in a form of Bayonet Neill-Concelman (BNC) radio-frequency connector, and the like. A guide groove extending in an axial direction and a locking groove extending in a circumferential direction are provided on the locking member 4. The locking groove communicates with the guide groove. The guide groove is in sliding fit to the guide post. When the locking member 4 moves downward until the guide post is aligned to the locking groove, the locking member 4 is rotated, so that the guide post enters the locking groove, to lock the locking member 4 in the axial direction. During unlocking, the locking member is reversely rotated, and after the guide post enters the guide groove, the locking member 4 moves upward under the elastic force of the elastic member 7.

Figure 6:
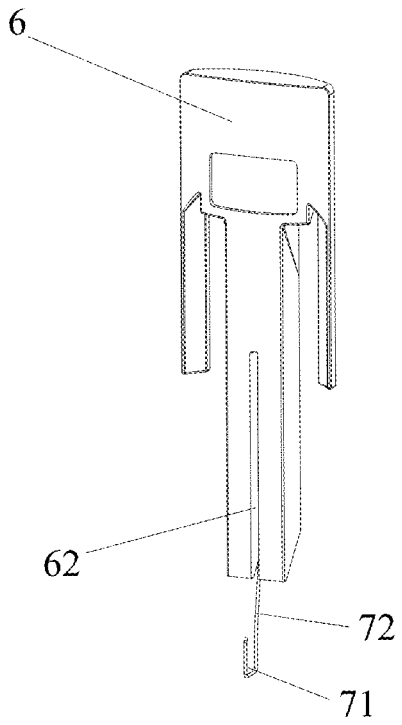
FIG. 6 is a schematic diagram showing an assembly of a front surface of the clamping member and an elastic member in an implementation of this application.
Figure 7:
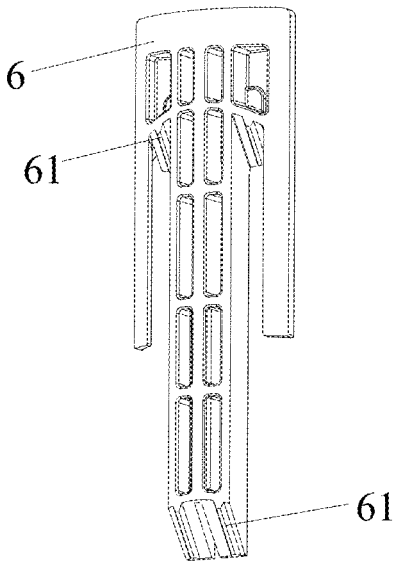
FIG. 7 is a structural schematic diagram showing a back surface of a clamping member in an implementation of this application.

Specifically, a structure of the clamping member 6 is shown in FIG. 6 and FIG. 7. The clamping member 6 is a flat structural part, and includes a front surface and a back surface that are opposite to each other. The sliders 61 are disposed on the back surface of the clamping member 6, and the front surface of the clamping member 6 is capable of being in contact with the placed object. A mounting groove 62 is further provided in a lower part of the clamping member 6, and the elastic member 7 is fixed in the mounting groove 62.

Further, a shape structure of the elastic member 7 is as shown in FIG. 6. The elastic member 7 includes an upper long-bar-shaped fixed part 72 and a lower bent part 71. The fixed part 72 is disposed in the mounting groove 62 in the lower part of the clamping member 6. The bent part 71 extends downward and is fixed onto the supporting body 3. Specifically, a clamping groove 35 corresponding to the bent part 71 is provided on the supporting body 3, and the bent part 71 is clamped in the clamping groove 35.

The elastic member 7 is connected to the clamping member 6, so that positions of the elastic member 7 and the clamping member 6 are fixed relative to each other. Action force of the elastic member 7 is capable of being directly acted on the clamping member 6, to push the clamping member 6 to return. Therefore, after the placed object is placed in a center of the supporting body 3, the locking member 4 is operated to move from top to bottom, so that the clamping member 6 slides toward the center of the supporting body 3 along the sliding groove 34 to clamp the placed object. In addition, the elastic member 7 deforms and bends to provide specific force feedback for a user, so that user experience is improved. When the locking member 4 moves upward, elastic force for bending and deforming the bent part 71 is released to drive the clamping member 6 to move in a direction away from the center of the supporting body 3 along the sliding groove 34, so as to return the clamping member 6.

Four sliders 61, two of which form a group, are disposed on the back surface of each clamping member 6, to ensure that the clamping member 6 is capable of stably sliding along the sliding grooves 34. Two sliders 61 in one group are symmetrically distributed with respect to a center line of the clamping member 6. The two groups of sliders 61 are distributed vertically. Correspondingly, in the placement groove 32, each clamping member 6 is correspondingly provided with four sliding grooves 34.

In a specific implementation of the supporting body 3: The supporting body 3 in this embodiment is rotatably supported in the first accommodating cavity 11 of the housing 1.

Figure 3:
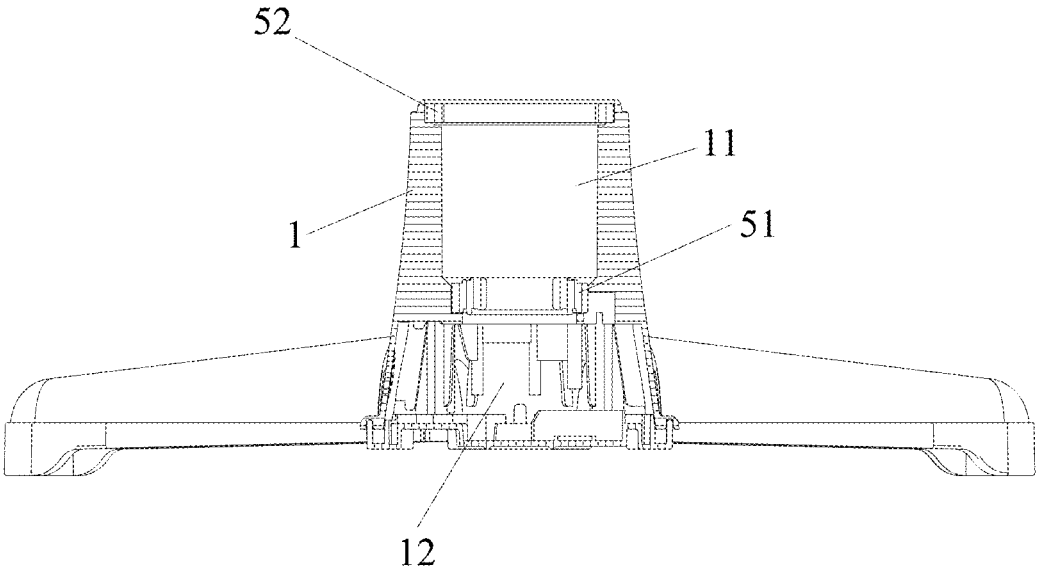
FIG. 3 is a sectional view showing a housing in an implementation of this application.
Figure 4:
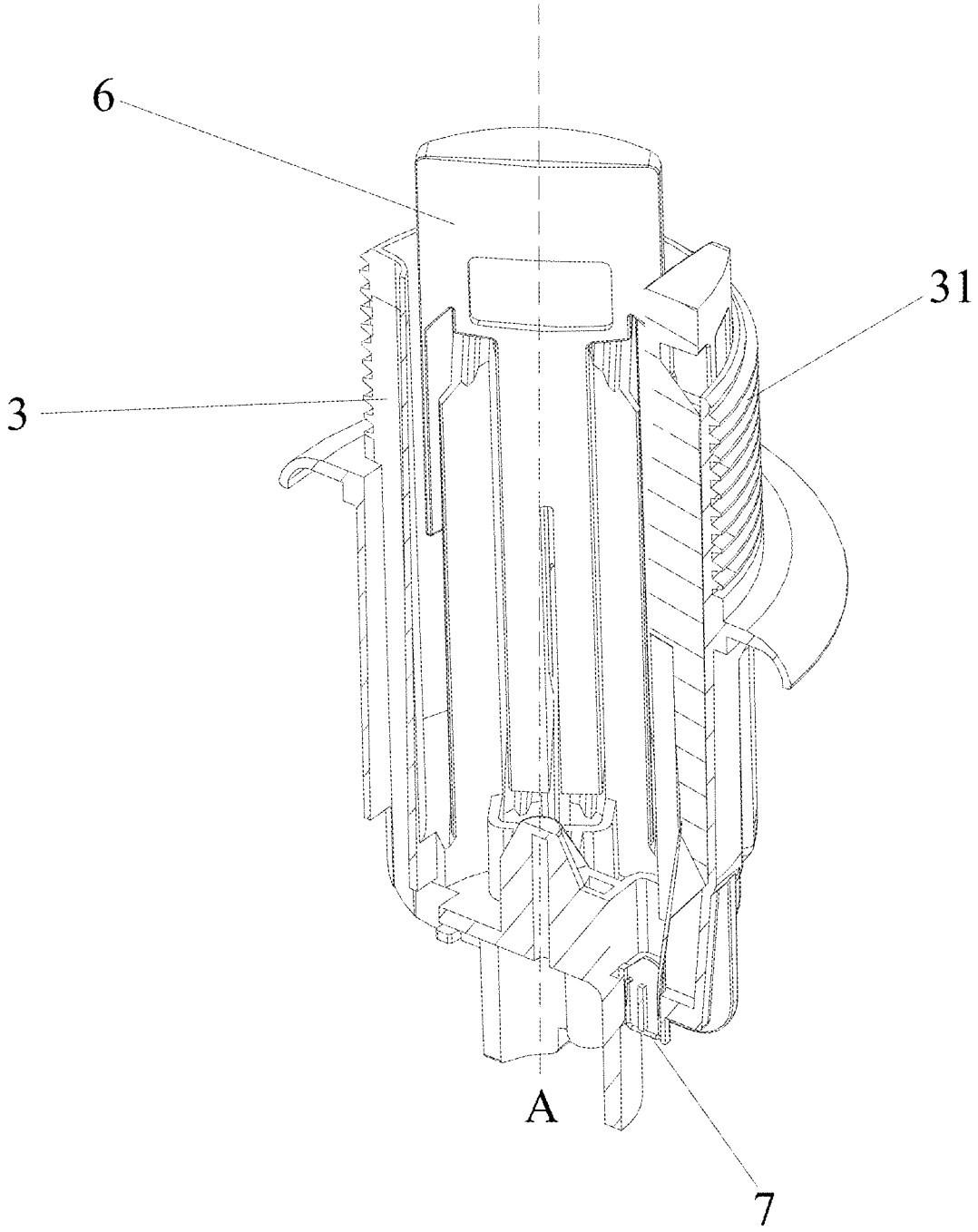
FIG. 4 is a sectional view showing an assembly of a supporting body and clamping members in an implementation of this application.
Figure 5:
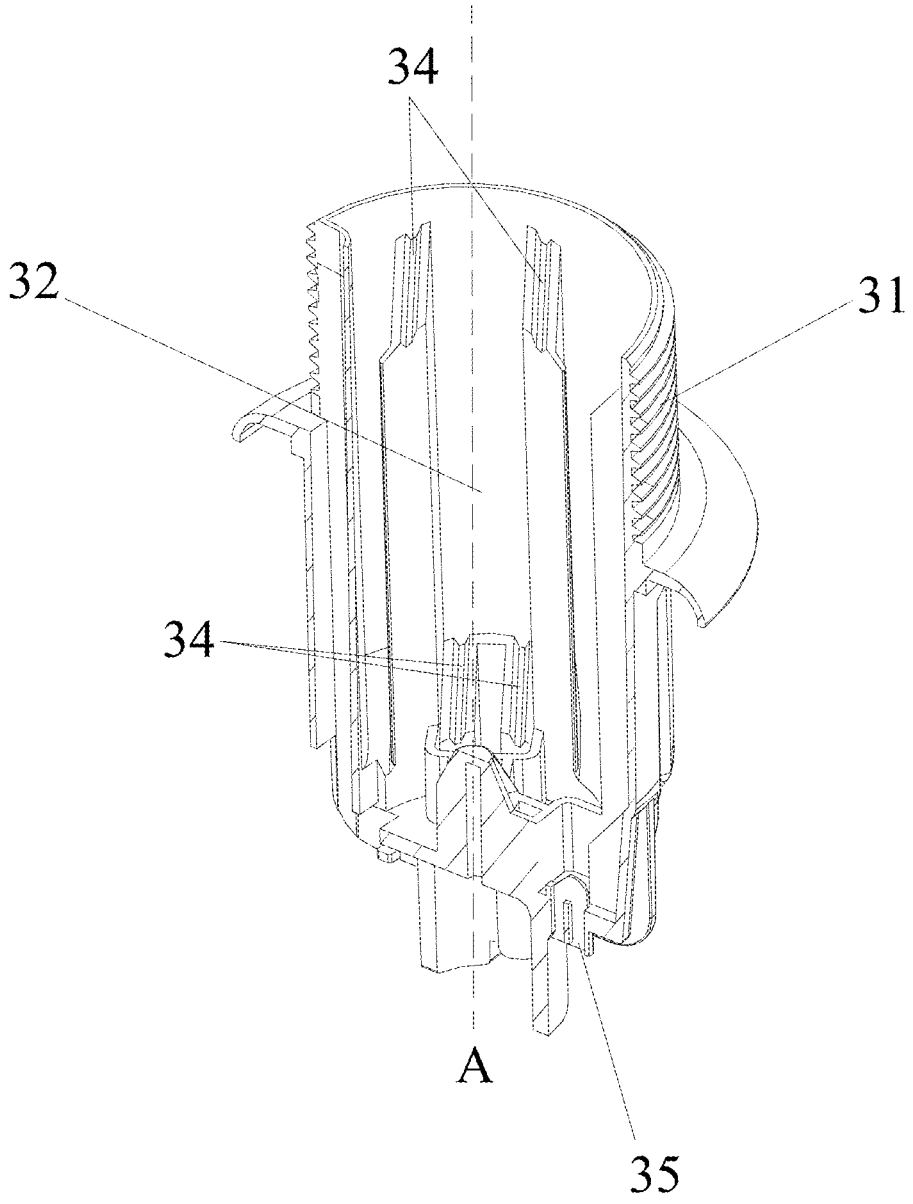
FIG. 5 is a sectional view showing a supporting body in an implementation of this application.
Figure 9:
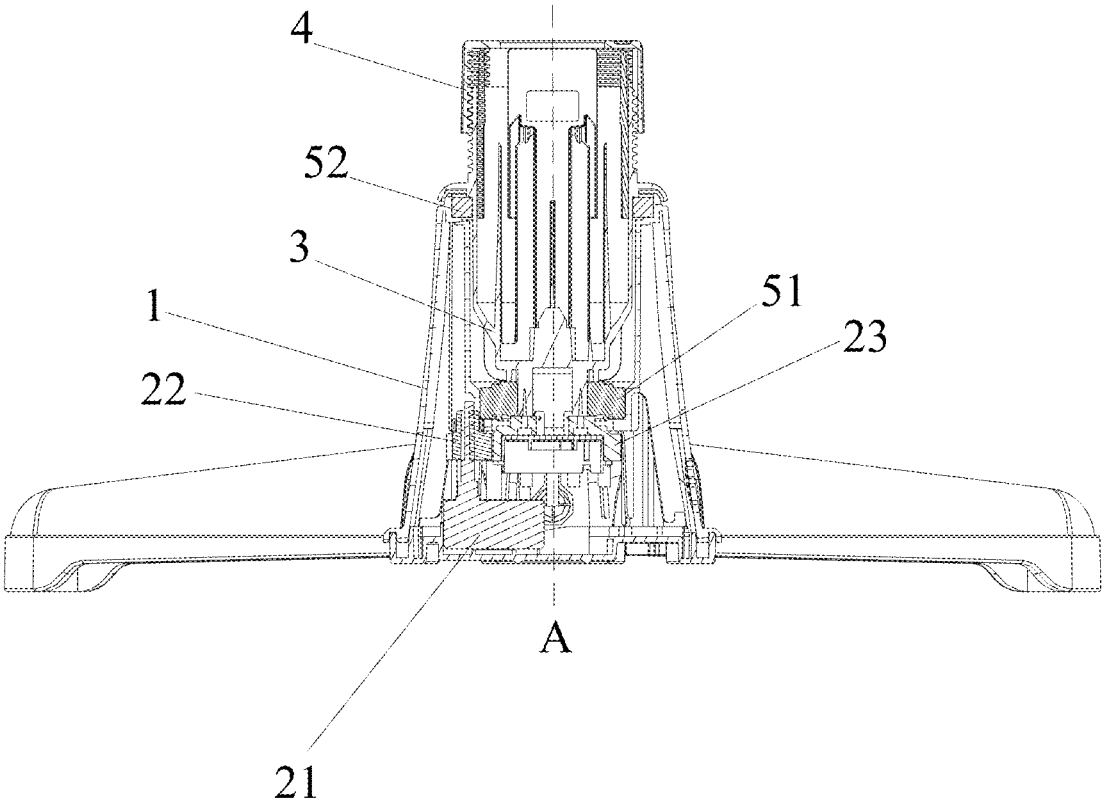
FIG. 9 is a sectional view showing the clamping base in an implementation of this application.

The supporting body 3 is rotatably mounted in the first accommodating cavity 11 via a bearing assembly, to facilitate rotation of the supporting body 3 in the first accommodating cavity 11. As shown in FIG. 3 and FIG. 9, a step (not shown in the figure) for bearing the bearing assembly is disposed in the housing 1. The bearing assembly includes a first bearing 51 and a second bearing 52. The first bearing 51 is disposed below the first accommodating cavity 11, and is sleeved on a lower part of the supporting body. The second bearing 52 is mounted above the first accommodating cavity 11, and is sleeved on an upper part of the supporting body 3. Under matching of the first bearing 51 and the second bearing 52, the supporting body 3 is capable of stably rotating.

In this application, the first bearing 51 may be a tapered roller bearing. Rolling bodies of the tapered roller body are at large contact angles with inner and outer conical surfaces, so that a heavy load can be distributed on each rolling body more uniformly, and pressure borne on a single rolling body is reduced. The first bearing 51 can be utilized to bear a load when the placed object is mounted in the supporting body, and has a high bearing capability. In addition, the second bearing 52 may be a cylindrical bearing with a low friction coefficient and high rotation precision, to match rotation of the supporting body.

In a further implementation, a second accommodating cavity 12 that communicates with the first accommodating cavity 11 is further defined in the housing 1. The second accommodating cavity 12 is positioned below the first accommodating cavity 11. The first bearing 51 is located between the second accommodating cavity 12 and the first accommodating cavity 11.

The supporting body 3 can be manually pushed to rotate. Alternatively, the supporting body 3 is driven by a corresponding transmission mechanism to rotate.

In this embodiment, the transmission mechanism is disposed in the second accommodating cavity 12, and the transmission mechanism is configured to drive the supporting body 3 to rotate at a set speed.

Figure 8:
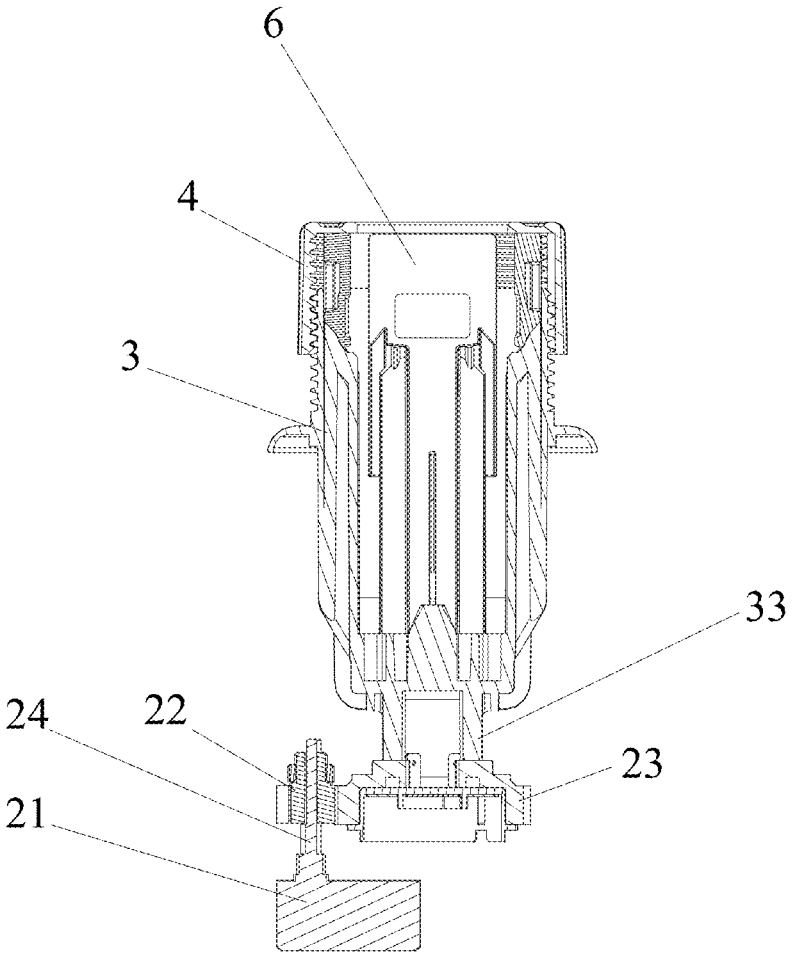
FIG. 8 is a sectional view showing an assembly of a transmission mechanism and a supporting body in an implementation of this application.

Specifically, as shown in FIG. 8, the transmission mechanism includes a motor 21, a first gear 22, and a second gear 23. The first gear 22 is connected to an output shaft 24 of the motor 21, and the first gear 22 is engaged with the second gear 23. It can be seen from FIG. 9 that, the first bearing 51 is sleeved on a rotatable connecting part 33 on the lower part of the bearing 3, and a lower end of the rotatable connecting part 33 of the supporting body 3 is connected to the second gear 23. The second gear 23 is positioned below the first bearing 51. The supporting body 3 is driven by a transmission effect of the gears to rotate between the first bearing 51 and the second bearing 52. In addition, clamping force between the clamping member 6 and the placed object is not affected. When the placed object is an ornamental product, for example, the Christmas tree, the supporting body 3 is capable of driving the placed object to slowly rotate, thereby improving a display effect and user experience.

Embodiment 2: In this embodiment, the transmission mechanism is cancelled on the basis of Embodiment 1, and the supporting body is fixed in the housing. Other settings are the same as those in Embodiment 1. In this case, the clamping base is configured to clamp a non-ornamental product, and this type of product does not need to rotate for displaying after being fixed. For example, this type of product may be a base of a floor lamp, and is configured to clamp a lamp post.

Embodiment 3: A Christmas tree includes a Christmas tree body and the clamping base in Embodiment 1. A lower part of the Christmas tree body is clamped in the clamping base. A supporting body is driven by a transmission mechanism of the clamping base to rotate at a specific speed, so that an ornamental value of the Christmas tree is increased, and placement space of the Christmas tree is saved.

The above embodiments are merely intended to describe the technical solutions of this application, rather than to limit this application. It should be understood that, a person of ordinary skill in the art may still make modifications or equivalent substitutions to the specific embodiments of this application without departing from the spirit and scope of this application, and these modifications or equivalent substitutions shall fall within the protection scope of the to-be-approved claims of this application.

What is claimed is:

1. A clamping base, comprising a housing, a supporting body disposed in the housing, and a plurality of clamping members and a locking member that are mounted on the supporting body, wherein a placement groove configured to accommodate a placed object is defined in the supporting body, a plurality of sliding grooves are obliquely defined on an inner wall of the placement groove, the sliding grooves extend toward a center of the placement groove from top to bottom, the plurality of clamping members are circumferentially disposed in the placement groove, and sliders capable of sliding along the sliding grooves are disposed on the clamping members; and the locking member is connected to an upper part of the supporting body; a ring-shaped pressing ring is disposed on a top of the locking member, and in a downward moving process of the locking member, the pressing ring is acted on upper end surfaces of the plurality of clamping members to push the plurality of clamping members to slide toward the center of the placement groove to clamp the placed object; and an elastic member capable of pushing the plurality of clamping members to return is further disposed between each of the plurality of clamping members and the supporting body.

2. The clamping base according to claim 1, wherein the elastic member comprises a fixed part and a bent part, the fixed part is disposed on the plurality of clamping members, and the bent part is clamped on the supporting body.

3. The clamping base according to claim 2, wherein a mounting groove is defined on each of the plurality of clamping members, and the fixed part of the elastic member is disposed in the mounting groove; and a clamping groove is provided on the supporting body, and the bent part of the elastic member is clamped in the clamping groove.

4. The clamping base according to claim 1, wherein the supporting body is rotatably supported on the housing.

5. The clamping base according to claim 4, wherein a first accommodating cavity is defined in the housing, a first bearing is disposed below the first accommodating cavity, a second bearing is disposed above the first accommodating cavity, and the supporting body is rotatably mounted in the first accommodating cavity via the first bearing and the second bearing.

6. The clamping base according to claim 5, wherein a second accommodating cavity that communicates with the first accommodating cavity is further defined in the housing, the second accommodating cavity is positioned below the first accommodating cavity, a transmission mechanism is mounted in the second accommodating cavity, and the transmission mechanism is configured to drive the supporting body to rotate.

7. The clamping base according to claim 6, wherein the transmission mechanism comprises a motor, a first gear, and a second gear, the first gear is mounted on an output shaft of the motor, and the second gear is mounted on a lower end of the supporting body, and is engaged with the first gear.

8. The clamping base according to claim 7, wherein a rotatable connecting part is disposed on the lower end of the supporting body, the first bearing is sleeved on a periphery of the rotatable connecting part, and the second gear is disposed on a lower end of the rotatable connecting part.

9. The clamping base according to claim 1, wherein the supporting body is fixed on the housing.

10. A Christmas tree, comprising a Christmas tree body and the clamping base according to claim 1, wherein the Christmas tree is mounted on the clamping base.

* * * * *